United States Patent [19]

Dobija

[11] 4,008,549

[45] Feb. 22, 1977

[54] PANEL MOLDING SYSTEM

[75] Inventor: Michael J. Dobija, New Philadelphia, Ohio

[73] Assignee: Masonite Corporation, Chicago, Ill.

[22] Filed: Aug. 15, 1975

[21] Appl. No.: 605,025

[52] U.S. Cl. ..... 52/287; 52/288

[51] Int. Cl.[2] ..... E04F 19/02

[58] Field of Search ..... 52/288, 287, 290, 716

[56] References Cited

UNITED STATES PATENTS

| | | | |
|---|---|---|---|
| 258,837 | 5/1882 | Willson | 52/288 |
| 3,086,262 | 4/1963 | Kawtz | 52/287 X |
| 3,481,092 | 12/1969 | Constantino | 52/288 |

*Primary Examiner*—John E. Murtagh
*Attorney, Agent, or Firm*—Mason, Kolehmainen, Rathburn and Wyss

[57] ABSTRACT

A panel molding system comprising in combination a first corner member having an outer viewing face and an opposite back face adapted to confront a wall surface or the like, said first member having a base portion along the lower edge of said faces and having a support surface adapted to rest on a floor or the like and including a rib extending away from the outer face and a second member having an outer viewing face and an opposite back face adapted to bear against a wall surface, said second member having groove means defined in the outer face spaced between upper and lower edges and dimensioned to receive at least a portion of the rib of the first member placed in partially overlapping relation on the second member.

12 Claims, 7 Drawing Figures

PANEL MOLDING SYSTEM

BACKGROUND OF THE INVENTION

1. Field of the Invention

The present invention relates to a new an improved panel molding system and more particularly to a panel molding system which is adapted for use in decorating paneled walls of variable heights to provide decorative profiles along the floor or base, along an intermediate level such as the level of a chair rail and along the ceiling.

2. Description of the Prior Art

Prior art panel systems have employed matched moldings of relatively simple profiles, but for the most part, prior systems have not placed emphasis on the decorative aspects and the fact that paneled walls of different heights require moldings of different widths to provide a functional and decorative visual foundation for the wall decor. In this connection, prior art systems normally have provided only a single molding of relatively narrow width and these moldings often do not lock well on walls that are relatively high. Moreover, prior systems have not provided the needed variety of molding widths for more aesthetic treatment of paneled walls and the like.

SUMMARY OF THE INVENTION

It is an object of the present invention to provide a new and improved panel molding system.

More particularly, it is an object of the present invention to provide a new and improved panel molding system which is adapted to provide a wide variety of molding combinations for improved wall decor of paneled walls.

Another object of the present invention is to provide a new and improved panel molding system wherein a basic molding may be utilized alone or in combination with one or more additional molding members in an attractive and tongue and groove interlocked combination to provide a wide variety of molding profiles with a minimum number of standard profile sections.

Another object of the present invention is to provide a new and improved panel molding system of the character described wherein a pair of molding members may be in tongue and groove interconnected relationship when overlapped to provide a broader width molding for improved appearance.

Another object of the present invention is to provide a new and improved panel molding system wherein a basic molding member may be utilized in combination with one or more secondary molding members in a variety of combinations interlocked together.

Another object of the present invention is to provide a new and improved panel molding system which is easy to install, relatively low in cost, physically strong and which provides for a wide variety of appearances.

These and other objects and advantages of the present invention are accomplished in the several illustrative embodiments, one of which comprises a panel molding system having in combination a first or base corner molding member having an outer viewing face and an opposite back face adapted to confront a wall surface of the like. The base member includes a base portion along a lower edge of the face having a support surface adapted to rest or bear against the floor or the like and includes a rib extending away from the outer face. A secondary molding member having an outer viewing face and an opposite back face adapted to bear against the wall surface is provided and the secondary member includes groove means formed in the outer face spaced between the upper and lower edges and dimensioned to receive at least a portion of the rib of the base member when placed in partially over-lapping relation upon the second member. The base corner member may be utilized alone and/or the combination may be utilized to provide a more massive and decorative pleasing appearance. The combination may also be enlarged to include a third molding member having an outer viewing face and an opposite face adapted to confront a wall surface or the like. The third member is also provided with groove means in the outer surface intermediate the upper and lower edges and the secondary member has a rib extending away from the outer face adapted to seat in the groove means of the third member dimensioned to receive the rib when the secondary member is placed in partially overlapping relation on the third molding member.

BRIEF DESCRIPTION OF THE DRAWINGS

For a better understanding of the present invention reference should be had to the following detailed description taken in conjunction with the drawings in which.

DESCRIPTION OF THE PREFERRED EMBODIMENTS

Figures 1, 2, 3, 4:
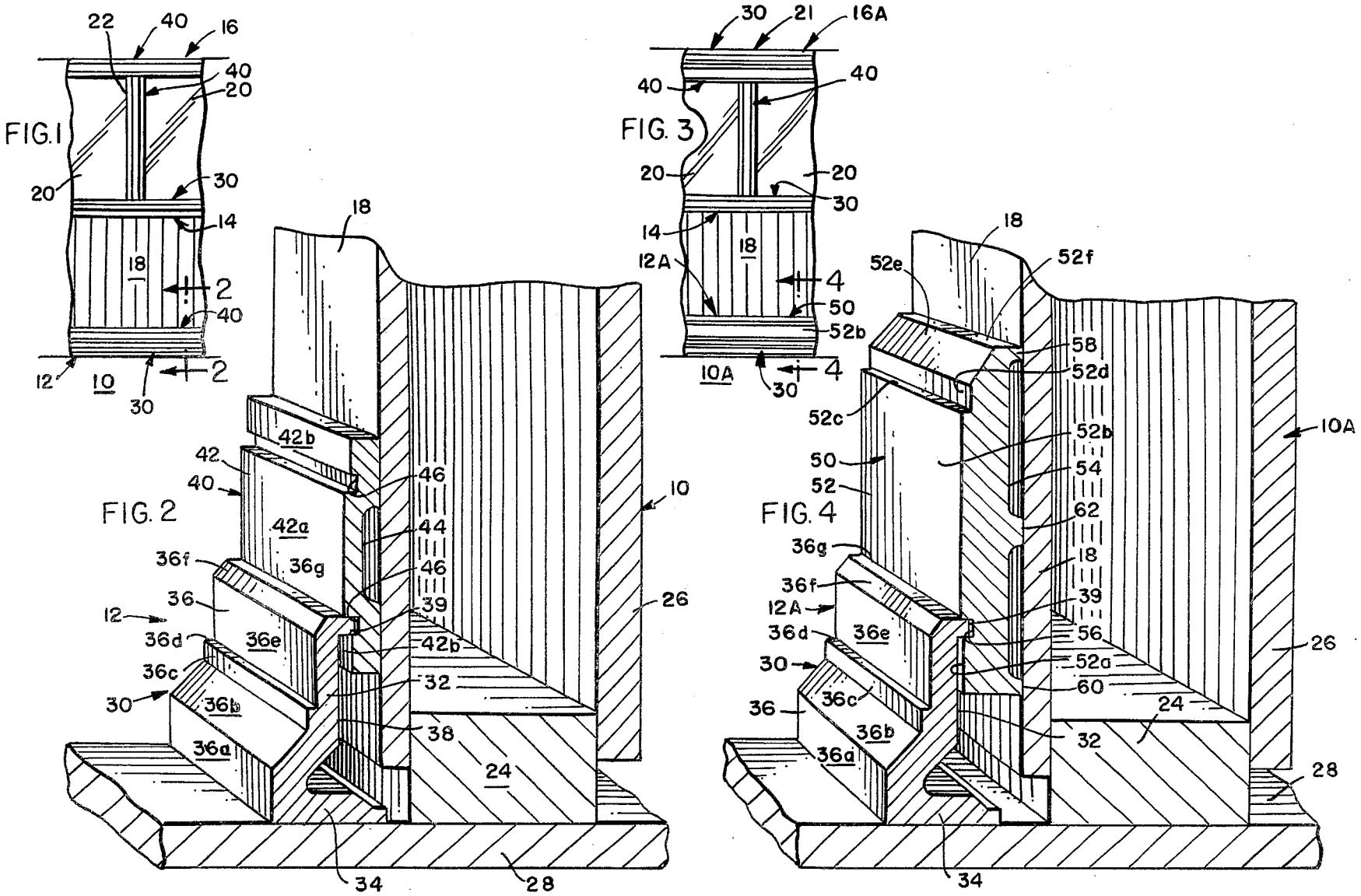
FIG. 1 is an elevational view of a wall section treated with a panel molding system constructed in accordance with the features of the present invention.
FIG. 2 is an enlarged fragmentary sectional view taken substantially along lines 2—2 of FIG. 1.
FIG. 3 is an elevational view of a wall section treated with another combination encompassed by the panel molding system of the present invention.
FIG. 4 is an enlarged fragmentary sectional view taken substantially along lines 4—4.

Referring now to FIGS. 1 and 2, therein is shown a paneled wall structure 10 trimmed with a composite base molding 12, an intermediate or chair rail level molding 14 and a ceiling molding 16 constructed in accordance with the panel molding system of the present invention. The wall structure 10 includes vertically grooved wall panels 18 extending between the base molding 12 the the intermediate level molding 14 and a plurality of windows 20 or other panels extending between the intermediate level molding 14 and the ceiling or top level molding 16. The panels 20 are separated by vertical mullions 22.

As shown in enlarged detail in FIG. 2, the wall structure 10 may include a two by four frame 24 or other type of structural system covered with wall boards 26 on one or both sides. The wall structure extends upwardly between floor structure 28 and a ceiling (not shown) and the base molding 12 of the present invention is adapted to beautify and trim the wall along the base or floor line.

Figure 7:
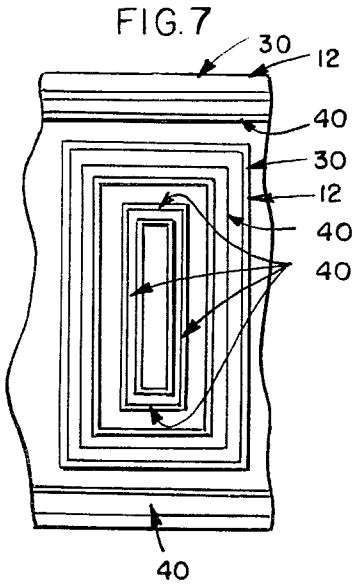
FIG. 7 is an elevational view illustrating how the molding members of the panel molding system of the present invention may be used individually and in combinations to provide a decorative architectural interest for wall surfaces, door, cabinet or picture frames, window treatment and the like in order to magnify and improve the visual interest.

The base molding 12 includes a base or primary elongated molding strip 30 formed of wood or other material having an upstanding leg 32 and a base or shoe 34 at right angles adapted to rest upon the floor structure 28. The base molding member includes an irregular outer viewing face 36 and an opposite or back face 38 adapted to confront the wall 10 or panel 18 when positioned in place as shown in FIG. 2. The outer viewing face of the base molding strip includes a lower face segment 36*a*, a sloping segment 36*b* extending upwardly thereof and a vertical segment 36*c* of relatively narrow width is formed adjacent the upper edge of the sloping segment. A narrow horizontal segment 36*d* extends at right angles along the upper edge of the narrow vertical segment 36*c*. A relatively wide vertical segment 36*e* extends upwardly from the narrow horizontal segment 36*d* and a narrow sloping segment 36*f* extends upwardly along the upper edge of the relatively vertical face segment 36*e*. The upper surface of the base molding strip comprises a horizontal top 36*g* forming the upper surface of a rearwardly extending rib 39 formed along the upper edge of the base molding strip. The outer viewing face 36 of the base molding thus includes a plurality of segments 38*a*–38*g* of different widths and slopes to provide extra visual interest and pleasing appearance for a wall trim because of the highlights, shadows and combinations thereof formed by the variety and orientation of the face segments. Along the base molding 30 may also be used for a framing member for mirrors, pictures, cabinets, doors, etc., in any number of different applications, for example as shown in FIG. 7.

The composite base molding 12 including the base 30 (with a profile as described) also includes a secondary molding or casing member 40 which may be used independently on the vertical mullions 22 between the window panels 20 and/or the upper or ceiling molding 16 as shown in FIG. 1. The secondary molding includes an outer viewing surface 42 and an opposite back face 44 adapted to confront and normally contact a wall surface such as the paneling 18 as shown in FIG. 2. The outer viewing face includes a relatively wide, centrally disposed face segment 42*a* flanked on opposite sides by a pair of relatively narrow inwardly offset, face segments 42*b*. The large center face segment 42*a* and the upper and lower narrower face segments 42*b* of the outer viewing face 42 are separated by a pair of indented grooves 46. These grooves provide shadows and contrast and are appropriately dimensioned to receive the rib 39 of the base molding 30 when the moldings 30 and 40 are interconnected in composite overlapping relation as shown in FIG. 2 to form the base molding 12. The rib 39 of the base molding and the grooves 46 of the secondary narrow casing molding form a tongue and groove joint for positively interlocking the moldings together to form the relatively wide composite base molding 12.

On the wall structure 10, the ceiling molding 16 and the vertical mullions 22 may be provided by applying segments of the secondary narrow casing 40. The intermediate level molding 14 may be formed by the base molding 30 in an inverted position with the base or shoe portion 34 providing a counter like top or cap. The panel molding system as described using base molding 30 alone or in combination with secondary casing members 40 which also may be used alone for some purposes as described provides a system with a wide variety of choices for a decorator. The system is rich in highlights, shadows, extra visual interest and is extremely pleasing to the eye.

Referring now to FIG. 3, therein is illustrated another embodiment of a wall structure 10A generally similar to the structure 10 as previously described but including a wider composite base molding 12A, the same intermediate level molding 14 (comprising a single base 30 in inverted position) and a relatively wide upper ceiling molding 16A comprising the composite base molding 12 of FIGS. 1 and 2 in inverted position. The modified wider base molding 12A as shown in FIGS. 3 and 4 includes in combination with the base molding 30 a secondary casing member 50 having both a width and thickness substantially greater than the relatively thin and narrow casing member 40 as previously described. The wide casing member 50 includes an outer viewing face 52 and an opposite or back face 54 adapted to bear against the surface of a wall such as the wall panel 18. The outer viewing face 52 is formed with a relatively narrow lower face segment 52*a* and a relatively wide intermediate face segment 52*b* separated from one another by a groove 56 dimensioned to receive the rib 39 of the base molding 30 when placed in overlapping relation to form a tongue and groove combination as shown. The outer viewing face of the wide molding 50 includes a narrow horizontal face segment 52*c* along the upper edge of the intermediate face segment 52*b* and a narrow vertical face segment 52*d* extends upwardly from the face segment 52*c*. A sloping face segment 52*e* is provided adjacent the upper edge of the vertical face segment 52*d* and the upper edge of the casing member 50 is formed by a horizontal face segment 52*f*, which segment forms the upper edge surface of a rearwardly extending rib 58 along the upper edge of the casing member. A similar rearwardly extending rib 60 is formed along the lower edge of the casing and an intermediate land 62 is provided at mid level on the casing member between the ribs on the back face 54. As shown in FIG. 4, the ribs 58 and 60 and the land 62 are adapted to bear against a wall surface such as the wall panel 18 when the wide casing member 50 is used in combination with the base molding 30 to form the modified composite relatively wide base molding section 12A.

Figure 5:
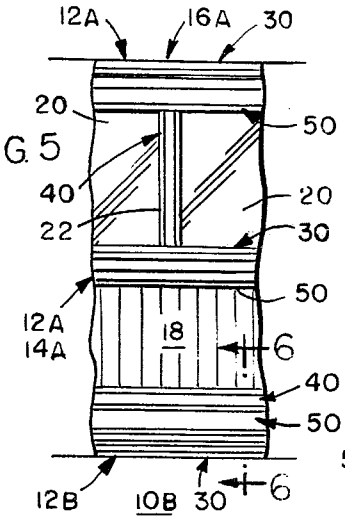
FIG. 5 is an elevational view of a wall section treated with yet another combination encompassed by the panel molding system of the present invention.

Referring now to FIG. 5, therein is illustrated another embodiment of a wall structure indicated by the reference number 10B and generally similar to the wall structures 10 and 10A as previously described. The structure 10B includes a somewhat wider composite base molding 12B and an intermediate level molding 14A which comprises the same composite base molding 12A as in the prior embodiment of FIGS. 3 and 4. In addition, the wall structure 10B includes a ceiling molding 16A also like the composite base molding 12A in the prior embodiment. Accordingly, the intermediate level molding 14A an the ceiling molding 16A of the wall structure 10B will not be described in detail.

Figure 6:
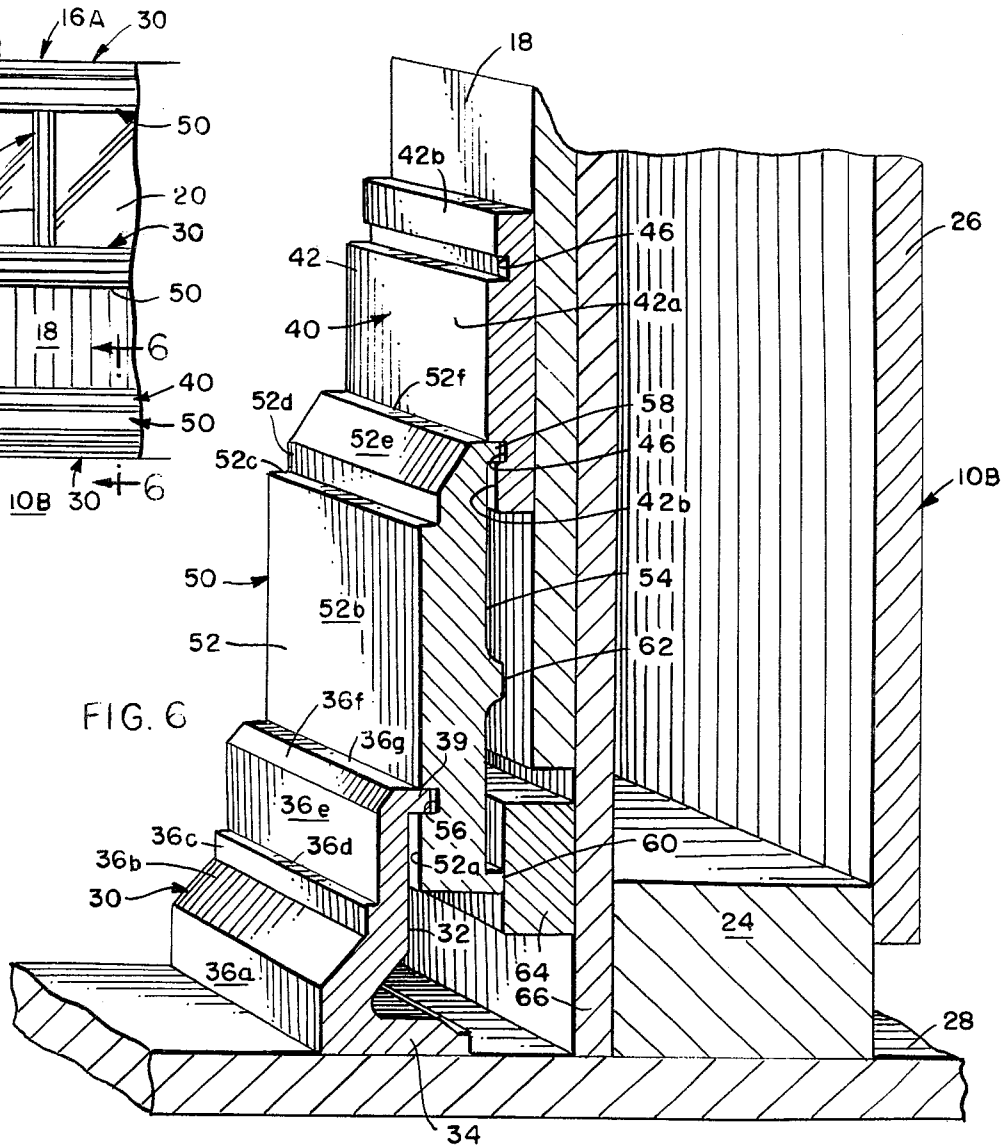
FIG. 6 is an enlarged fragmentary sectional view taken substantially along lines 6—6 of FIG. 5.

Referring to FIG. 6, the composite molding 12B includes in combination, the base molding 30 having its rib 39 in tongue and groove interlocking relation within the groove 56 of a secondary wide molding strip 50. The upper rib 58 of the wide molding strip 50 is in turn interlocked in tongue and groove relation within the lower groove 46 of a third member of the combination comprising the secondary casing or molding strip 40.

The combination of three elements making up the composite molding 12B thus provides a massive appearance and is rich in shadows and detailed visual effect. As shown in FIG. 6, the lower rib of the wide secondary molding stip 50 is adapted to bear against a spacer or furring strip 64 and this strip along with the vertical wall panels 18 are preferably applied to the wall structure over underlayment backing board 66 attached to the structural framing members.

Referring to FIG. 7, it will be seen that the molding strips 30, 40 and 50 may be used in a variety of combinations to provide frames suitable for pictures, mirrors, cabinets, windows, doors and the like and the novel interlocking tongue and groove arrangement between the several molding strips when assembled together in composite moldings of various combinations as described, provides a means for giving a decorator a wide variety of choices for an aesthetic design but an economical basis.

Although the present invention has been described with reference to the illustrative embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. A panel molding system comprising, in combination;

a first elongated molding member having an outer viewing face and an opposite back face adapted to confront in spaced apart relation a wall surface or the like, said first member having a longitudinally extending base portion along a lower edge of said faces having an inwardly extending support surface adapted to rest on a floor or surface at right angles to said wall surface, and including a longitudinally extending rib projecting oppositely away from said outer face toward said wall surface, and a second elongated molding member having an outer viewing face and an opposite back face adapted to confront said wall surface, said second member adapted to be spaced from said floor or right angle surface and having a longitudinally extending groove defined in said outer face thereof and spaced between upper and lower edges dimensioned to interlockingly receive at least a portion of said rib of said first member when placed in partially overlapping relation on said second member.

2. The combination of claim 1 wherein said longitudinal rib is positioned adjacent an upper edge of said first member and includes at least a portion extending parallel of said base portion.

3. The combination of claim 1 wherein said outer viewing face of said first member includes at least one pair of surface segments in spaced parallel relation.

4. The combination of claim 3 wherein said outer viewing face further includes an intermediate surface segment interconnected at opposite edges with adjacent edges of said pair of surface segments.

5. The combination of claim 4 wherein said intermediate surface segment is displaced in an arcuate angular relation with at least one of said pair of surface segments.

6. The combination of claim 4 wherein said intermediate surface segment is at right angles with said pair of surface segments.

7. The combination of claim 1 further including, in combination;

a third elongated molding member having an outer viewing face and an opposite face adapted to confront a wall surface or the like, said third member having a longitudinally extending groove defined in said outer face intermediate upper and lower edges thereof, said second member having a longitudinally extending rib projecting oppositely away from said outer face thereof, said longitudinal groove in said third member dimensioned to receive said longitudinal rib of said second member placed in partially overlapping relation on said third member.

8. The combination of claim 1 wherein said outer viewing face of said first molding member includes at least one pair of vertical face segments in horizontally offset relation.

9. The combination of claim 1 wherein said outer viewing face of said first molding member includes at least one face segment sloping relative to an adjacent vertical face segment.

10. The combination of claim 1 wherein said outer viewing face of said second molding member includes a central face segment and a pair of smaller outside face segments along opposite edges offset from said central segment.

11. The combination of claim 10 wherein said groove means is defined between said central face segment and at least one of said outside face segments.

12. The combination of claim 7 and wherein said third molding member includes a large central face segment and an outside face segment adjacent an edge and sloped with respect to said central face segment.

* * * * *